US008025614B2

(12) United States Patent
Newburger et al.

(10) Patent No.: US 8,025,614 B2
(45) Date of Patent: Sep. 27, 2011

(54) EXERCISE MAT AND SYSTEM FOR ENSURING PROPER FORM AND POSTURE DURING EXERCISE

(76) Inventors: Amy Newburger, Greenwich, CT (US); Paula Carnabuci, Cold Spring, NY (US)

( * ) Notice: Subject to any disclaimer, the term of this patent is extended or adjusted under 35 U.S.C. 154(b) by 94 days.

(21) Appl. No.: 11/825,988

(22) Filed: Jul. 10, 2007

(65) Prior Publication Data

US 2010/0267532 A1 Oct. 21, 2010

(51) Int. Cl.
*A63B 21/00* (2006.01)

(52) U.S. Cl. ..... 482/130; 482/35; 482/142

(58) Field of Classification Search ..... 482/23, 482/35, 130, 142; 297/465, 466; 128/872, 128/875; 5/926, 81.1, 922
See application file for complete search history.

(56) References Cited

U.S. PATENT DOCUMENTS 4,858,625 A * 8/1989 Cramer ..... 128/872
5,333,623 A * 8/1994 Fuller ..... 128/875
5,439,008 A * 8/1995 Bowman ..... 128/875
5,551,934 A * 9/1996 Binette ..... 482/123
6,042,189 A * 3/2000 Wellman ..... 297/465
6,560,793 B2 * 5/2003 Walker ..... 5/81.1 T
7,207,932 B1 * 4/2007 Dean ..... 482/140

* cited by examiner

*Primary Examiner* — Jerome W Donnelly

(74) *Attorney, Agent, or Firm* — St. Onge Steward Johnson & Reens LLC

(57) ABSTRACT

An exercise system preferably having a mat dimensioned to support a user stretched out on the floor. The mat has a central fastening band disposed widthwise across the mat. A belt fits around the midsection of the user adapted to be aligned with and at least partially adhere to the fastening band of the mat. The user is intended to perform certain flexibility exercises with the belt in contact with the fastening band. If the user lifts her midsection off of the mat during such exercises, the removal of the belt makes an audible noise (and the mat tugs on the user) to cue the user to reposition her body flat on the mat. The fastening band preferably includes one half of a hook-and-loop-type fastener and the belt comprises the other mating half. Alternatively, one or both of the band and belt may be provided with an adhesive material.

17 Claims, 3 Drawing Sheets

100
30

100
30

100
20
10

100
30
20
110

100
30
20

30
20

30
20

EXERCISE MAT AND SYSTEM FOR ENSURING PROPER FORM AND POSTURE DURING EXERCISE

BACKGROUND OF THE INVENTION

1. Field of the Invention

The invention relates to exercise equipment pertaining to stretching, yoga, abdominal muscle core-based exercises, and other similar exercises performed whilst on a mat on the floor. More specifically, the invention relates to a new mat and belt that ensures that a person performing stretching, yoga, or the like maintains the correct positioning of his or her body during the exercises so as to maximize the benefit received from the exercise and minimize the chance of injury during the exercise.

2. Description of Related Art

Exercise is fundamental and critical for maintaining good health. It is important to perform a wide variety of different types of exercise for the best results, e.g., cardiovascular, strength training, resistance training, stretching, flexibility, yoga, etc. Many of these exercises can be performed by a person merely positioning his or her body in different configurations and/or repeatedly moving various parts of the body. A mat is often used to provide the person with a cushioned and cleaner surface on which to exercise than on the floor.

Among the abdominal core-based exercise methodologies, Pilates may be the most well known. These exercise systems focus on improving flexibility and strength for the total body, without building body mass or bulk. Pilates was created by a nurse/therapist named Joseph Pilates. These as the other abdominal muscle core-based exercises are designed to strengthen the so-called critical core muscles that support, align and maintain the spine, among other benefits. In recent years, Pilates and similar exercises have entered the fitness mainstream. Over 10 million Americans are now believed to practice Pilates or a similar abdominal muscle core-based exercise regimen, and the number continues to grow.

Concomitant with its rapid success, Pilates and other exercise regimes are offered with some element of risk. For example, many people take large group exercise classes in which individual attention is limited or substantially nil. Many more people purchase pre-recorded exercise videos and exercise at home with absolutely no input from a live instructor. Even with proper supervision, many people have a very difficult time planting their midsections (lower backs when supine, pelvic region when prone, or hip when on one's side) against the floor or mat, leaving them not only confused, but frustrated, and worse yet susceptible to injury. At the least, improper position and alignment may not be as beneficial as proper body location and placement. A workout is most effective when one locks into one's core muscles and works the body in essence from the "inside out" To successfully exercise using the Pilates system, one must have the ability to secure or plant the body down, articulate the spine, and keep the torso and pelvis relatively stable. One may benefit from a personal trainer who is adequately educated, however it is an expensive option, and it is not available for many who work out at home in large groups, or alone, in any event.

Strengthening the abdominal core muscles and these types of body exercises are believed a crucial part of rehabilitation after back injury and/or surgery. The present device is considered highly useful for these purposes, too. Even bed-ridden patients need abdominal muscle strengthening exercises to maintain muscle tone. Again, the present invention is considered highly beneficial in that regard. Urinary incontinence sufferers, too, whose incontinence is based on a lack of pelvic muscle tone may also benefit from exercises by use of the present invention.

There is thus believed a long and widely-felt need for a simple, inexpensive means of ensuring a person keeps the relevant portion (usually the torso) of his or her body down in contact with the floor or mat while working and exercising the rest of the body. Abdominal muscle core-based exercising is believed to be highly beneficial but results are considered maximized when the exercisers correct positioning is maintained.

SUMMARY OF THE INVENTION

The invention is an exercise system having a mat dimensioned to support a user stretched out on the floor. The mat has a substantially central fastening band attached to it and disposed widthwise substantially across the mat. A belt is provided, fittable around the midsection of the user and adapted to be aligned with and at least partially adhere to the fastening band of the mat. The user is intended to perform exercises with the belt in contact with the fastening band. If the user inadvertently lifts her midsection off of the mat during exercise, the removal of the belt will be against a force and further, such inappropriate movement makes an audible noise to audibly cue the user to reposition and/or maintain her body flat on the mat. The fastening band of the mat preferably includes one half of a hook-and-loop-type fastener, and the belt comprises the other mating half of the hook-and-loop-type fastener. Alternatively, one or both of the band and belt may be provided with an adhesive material. As another alternative, the fastening band can be directly mounted to a floor, wall, or other workout surface and not made integral with a mat or other portable structure (i.e., a studio may be provided with one or more fastening band "stations" secured to the floor or wall(s), while individuals bring their respective belts to the studio).

BRIEF DESCRIPTION OF THE DRAWINGS

FIGS. 8A-G are schematics depicting the use of the invention by an exerciser.

DETAILED DESCRIPTION OF THE INVENTION AND DRAWINGS

Description of the invention will now be given with reference to FIGS. 1-8. It should be understood that these figures are exemplary in nature and in no way serve to limit the scope of the invention, which is defined by the claims appearing hereinbelow.

Figure 1:
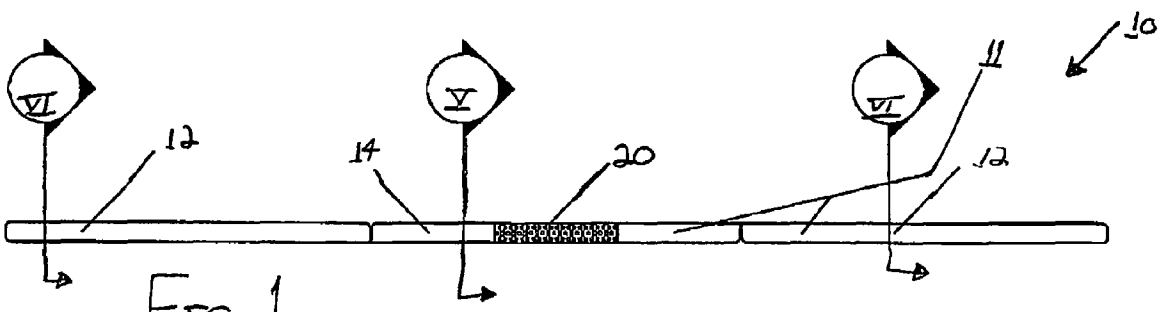
FIG. 1 is a side elevation view of a mat unfolded in accordance with the invention.
Figure 2:
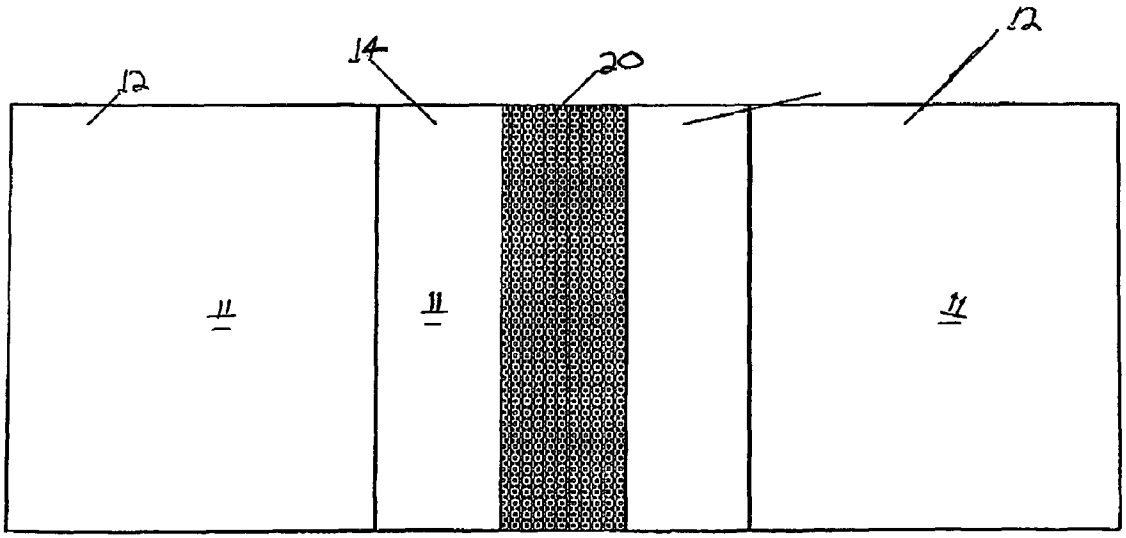
FIG. 2 is a top plan view of the unfolded mat of FIG. 1 in accordance with the invention.
Figure 4:
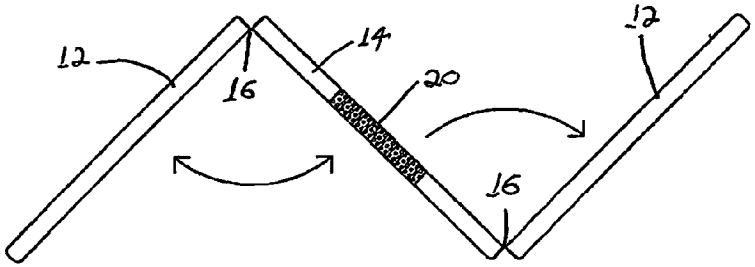
FIG. 4 is a side elevation view of the mat of FIGS. 1-3 as it is being unfolded.
Figure 5:
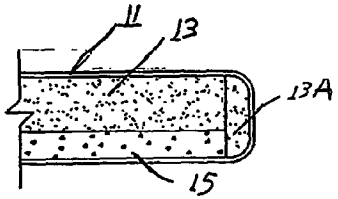
FIG. 5 is a partial, and sectional view of a central section of the mat of FIGS. 1-4, taken along line V of FIG. 1.
Figure 6:
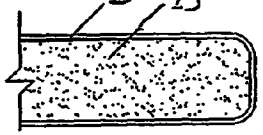
FIG. 6 is a partial, and sectional view of the upper and lower sections of the mat of FIGS. 1-4 taken along lines VI of FIG. 1.
Figure 3:
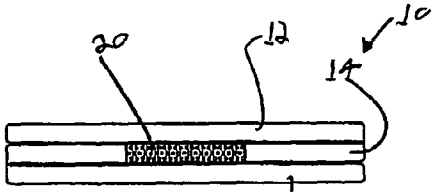
FIG. 3 is a side elevation view of the mat of FIGS. 1-2 in accordance with the invention, folded into a storage configuration.
Figure 7:
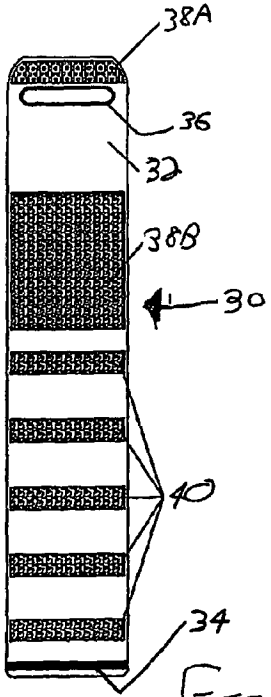
FIG. 7 is a top plan view of a belt in accordance with the invention.

The main components of the inventive exercise system are mat 10 (FIGS. 1-6) and belt 30 (FIG. 7). Mat 10 is preferably a three-sectioned exercise mat having a plastic (preferably vinyl) covering 11 and padding therein. It preferably includes upper and lower sections 12 and a central section 14 although the mat can be formed of one, two or more sections, as desired. As shown in FIGS. 3 and 4, the sections 12 and 14 are hingedly attached at hinges 16 (e.g., thin non-padded vinyl or fabric hinges) and can be folded up into a storage configuration (FIG. 3) or unfolded (FIG. 4) into a working configuration (FIGS. 1 and 2). As shown in FIGS. 5 and 6, the padding provided to sections 12 and 14 may include high density foam 13 in all sections, with the central section 14 having a layer of ultra-light mid-density foam 15 (See FIG. 5) as well. Central section 14 may also be provided with shaped high density foam edging 13A.

Central section 14 of mat 10 is also provided with fastening band 20 disposed widthwise substantially all the way across mat 10. In the preferred embodiment, fastening band 20 is one half of a hook-and-loop-type fastener such as Velcro® (e.g., band 20 is the hook portion). By "hook-and-loop-type fastener," it is intended to mean any Velcro®-like fastening system having one strip of repeating elements that matingly engage with another strip of repeating elements, and is not meant to be limited specifically to Velcro®. In the preferred embodiment fastening band 20 is centered in central section 14 and spans about one third of the length of the central section 14.

The other main component of the invention is belt 30 (see FIG. 7) which includes a main body 32 of preferably at least somewhat elastic material and a main belt loop 34. Pull slot 36 is provided at one end of belt 30, along with belt tip fastener 38A. Belt tip fastener 38A, preferably one half of a hook-and-loop-type fastener, is designed to be pulled (with the belt first wrapped around a wearers waist) through belt loop 34 and then folded back so that belt tip fastener 38A matingly engages corresponding or mating belt fastening section 38B (preferably the other half of the hook-and-loop-type fastener of that provided on belt tip fastener 38A) to enable belt 30 to be cinched snugly around the midsection or waist of a user. Belt loop 34 is secured at its ends to the side of the belt 30 but is sufficiently resilient or long to allow the belt tip 38A to pass between it and the belt portion beneath the belt loop 34. Other fastening systems may be employed for belt 30 instead of fastener 38A-B, e.g., snaps, buttons, etc. Additionally, belt 30 may be made as a continuous elastic loop with no fastener which the user slips her legs through to place around her midsection.

Belt 30 is provided with one or more strips 40 of one half of hook-and-loop-type fastener—the opposite half of that which makes up fastening band 20. It is preferred (but not required) to provide the fastening portion of belt 30 as multiple, discrete transverse strips 40 rather than a continuous section of fastening material so that belt 30 is more flexible, more comfortable, and more able to conform to the contours of the user. It is also preferred because if the adhering strength of the belt to the mat is too great and the fastening portion of belt 30 extends continuously around belt 30, belt 30 will be too tightly secured to mat 10 and the mat will simply move along with the user through both correct and incorrect postures. Thus, strips 40 are adapted to engage and at least partially adhere to fastening band 20 when a person wearing belt 30 lies down atop mat 10 in the proper position, and separate from fastening band 20 when the user moves out of contact with the mat, i.e., out of the proper position. In a preferred embodiment, five strips 40 are provided, 1.5 inches wide with 3 inch spaces between adjacent strips on a 42-inch long belt that is 8 inches across. The corresponding fastening band 20 in this embodiment is 8 inches wide and spans across mat 10 as shown in the drawings. The invention is not limited to these specific dimensions. Strips 40 engage fastening band 20 when the belt is worn and the wearer positions one's torso onto the mat.

In many exercises, it is preferred for the exerciser to keep her midsection as flat as possible against the mat, floor, wall, or other workout surface. The user of the inventive system will be provided with an audible signal i.e., she will hear when her midsection moves off of mat 20, in that the separation of hook-and-loop-type fastener elements from one another makes a noise. The user will hear this telltale noise and know to (try to) replant her midsection back down on the mat.

Figures 8A, 8B, 8D, 8E, 8F, 8G:
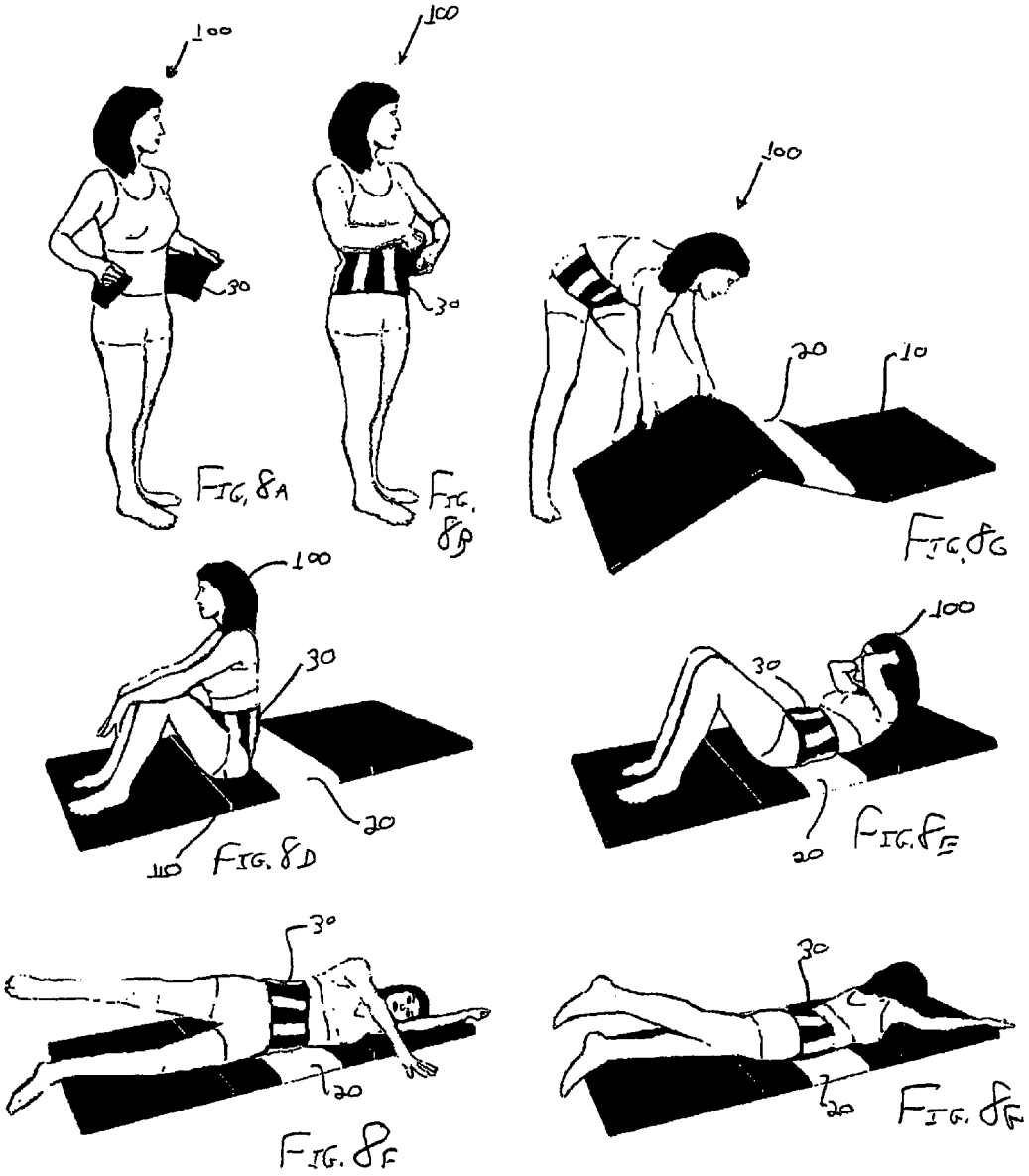

Use of the invention is shown schematically in FIG. 8. User 100 wraps belt 30 around her midsection in FIG. 8A and secures belt tip fastener 38A through belt loop 34, bends it back over the loop 34 and onto fastening section 38B in FIG. 8B. The hand grip 36 helps the user to tighten the belt. User 100 opens up mat 10 so that it is flat on the floor and so that fastening band 20 is facing upward, as in FIG. 8C (alternatively, fastening band may be provided on both main faces of mat 10 so that it does not matter which face is up). User 100 sits down on mat 10 (FIG. 8D) placing her posterior 110 near fastening band 20 so that, when she lies back down as in FIG. 8E, one or more strips 40 of belt 30 matingly engage and at least partially adhere to fastening band 20. In FIG. 8E, user 100 is doing abdominal "crunches," in which she should preferably only raise her upper body and legs while keeping her midsection flat and down on the mat. Should the user inadvertently and improperly lift her midsection as well as her upper body, or should she arch her lower back, strips 40 on belt 30 will pull away from fastening band 20 on mat 10 and generate an audible sound to cue the user to keep her posture correct. Furthermore, the corresponding hook and loop fastener facilitates maintaining correct positioning and exercise by tending to hold one's midsection flat onto the mat. User 100 may use the mat and belt system while lying on her side (see FIG. 8F) or lying prone (see FIG. 8G) as well.

The invention is not limited to the above description. For example, it is described that the fastening band 20 has one of the hooks or loops of the Velcro®-type fastener and the belt 30 has the other, however both the band and the belt may be provided with both sections of the hook portion and sections of the loop portion of the Velcro-type fastener. Additionally, for the embodiment provided with a sticky surface or adhesive on at least one of the fastening band 20 and the belt 30, the adhesive may be provided on one of or both of the band and the belt. As another alternative, the fastening band need not be attached to a mat but may be installed or placed directly onto a floor, a wall, or other workout surface.

Having described certain embodiments of the invention, it should be understood that the invention is not limited to the above description or the attached exemplary drawings. Rather, the scope of the invention is defined by the claims appearing hereinbelow and any equivalents thereof as would be appreciated by one of ordinary skill in the art.

What is claimed is:

1. An exercise system, comprising;

an exercise mat having a padded, cushion-providing thickness, dimensioned to support a user from head to foot stretched out-on it when on a floor, said mat having a substantially central-located fastening band attached to said mat and disposed to extend substantially across the width of said mat, said fastening band only extending in height about the height of a user's midsection; and a belt fittable around the midsection, and comprising one half of a hook and loop type fastener; of a user and adapted to be aligned with-said fastening band of said mat, said belt only securing the midsection of said user;

wherein an audible noise is generated when said user, said belt comprising a second half of a hook and loop type fastener in discrete transverse strips, and; inadvertently removes said belt from said fastening band.

2. An exercise system according to claim 1, wherein said mat has a pair of opposed flat surfaces and said fastening band only extends across a first of said surfaces.

3. An exercise system according to claim 1, said fastening band at least partially maintains a holding force to said belt so as to impart a tugging or pulling feeling to the user.

4. An exercise system, comprising:

a fastening band attached to a cushioned, flat when in use, yet individually transportable workout surface about the length of an exerciser, said fastening band having a height about that of the lower torso of an exerciser and extending substantially across the width of said workout surface; and a belt fittable around the lower torso of the exerciser user and adapted to be aligned with and at least partially secured to said fastening band yet releasable therefrom by movement of said exerciser, wherein if the user inadvertently lifts a portion of her lower torso off of said workout surface during exercise, the release of said belt from said fastening band makes an audible noise to cue the user to reposition his or her lower torso on said workout surface and, yet, said exerciser is not otherwise constrained in movement, and; wherein said fastening band comprises the other mating half of said hook and loop type fastener and wherein said belt is provided in discrete trans verse strips.

5. An exercise system according to claim 4, wherein said fastening band extends about the height of a lower torso of an exerciser using said exercise system.

6. An exercise system according to claim 4, said band is at least partially secured to said belt thereto so as to impart a tugging or pulling feeling to the exerciser.

7. An exercise system according to claim 4, wherein said workout surface is a mat having a pair of opposed flat surfaces with said fastening band only extending on a first of said surfaces.

8. An adjustable in circumference exercise belt for use by a user on a workout surface, comprising:

a main body fittable around and extending in height for substantially the entire midsection of the user; and at least one fastening strip disposed over the exterior surface of said main body adapted to be secured to a fastening band section attached to a workout surface, wherein if the user inadvertently lifts their midsection and said fastening strip of said belt off of the fastening band section of said workout surface during exercise, an audible noise is made to cue the user to maintain his or her body on the workout surface but said belt does not otherwise constrain movement of said exerciser; and Wherein said at least one fastening strip comprises a plurality of separated transverse strips extending across substantially the entirety of the height of the belt.

9. An exercise belt according to claim 8, wherein said fastening strip comprises one half of a hook-and-loop-type fastener adapted to be engageable with the corresponding mating section of a hook and loop type fastener of said fastening band section on the workout surface.

10. An exercise belt according to claim 8, wherein said fastening strip of said belt extends about 8 inches.

11. An exercising system to ensure proper positioning of the exerciser's lower torso and maintaining the same substantially flat on a support surface while exercising but not otherwise constraining the exerciser comprising: a cushion-providing floor mat of about the length of the height of an exerciser and having a hook or loop fastening element extending across its width at about the exerciser's corresponding midsection if the exerciser is lying on the mat and for about the height of the midsection of the exerciser and a belt to be worn by the exerciser, said belt having an outside surface comprising discrete transverse strips of the appropriately mating hook or loop fastening element.

12. An exercising system as claimed in claim 11 wherein said belt is adjustable to secure about a variety of midsection circumferences of different sized exercisers.

13. An exercising system as claimed in claim 11 wherein said floor mat is in three sections secured by seams and foldable by said seams for ease of personal carrying.

14. An exercising system as claimed in claim 13 wherein said hook or loop fastening section of said floor mat extends substantially across the width of only the middle of said three sections.

15. An exercising system as claimed in claim 11 wherein said hook or loop fastening section of said floor mat extends only about 8" wide.

16. An exercising system as claimed in claim 11 wherein said belt only extends about the lower torso of an exerciser.

17. An exercising system as claimed in claim 11 wherein the mechanical interaction of said hook or loop fastening element of said floor mat with said appropriately mating hook or loop fastening element of said belt provides an audible sound when the lower torso of an exerciser (adorned with said belt and lying on said floor mat with the belt in contact with said hook or loop fastening element of said floor mat) is moved in an exaggerated manner with respect to said floor mat.

* * * * *